United States Patent [19]

Drevet

[11] 3,958,901

[45] May 25, 1976

[54] AXIAL PISTON PUMP

[75] Inventor: Michel Drevet, Sevres, France

[73] Assignee: Compagnie des Services Dowell Schlumberger, Paris, France

[22] Filed: Oct. 5, 1973

[21] Appl. No.: 404,021

[30] Foreign Application Priority Data

Oct. 20, 1972 France ..... 72.37204

[52] U.S. Cl. ..... 417/269; 92/157; 184/6.17

[51] Int. Cl.[2] ..... F04B 1/12

[58] Field of Search ..... 417/269; 92/157; 184/6.17

[56] References Cited

UNITED STATES PATENTS

| | | | |
|---|---|---|---|
| 1,204,892 | 11/1916 | Macomber | 184/6.17 |
| 1,315,538 | 9/1919 | Burtnett | 184/6.17 |
| 1,839,592 | 1/1932 | Reynolds | 184/6.17 |
| 2,290,764 | 7/1942 | Neuland | 92/157 |
| 2,918,338 | 12/1959 | Grad | 92/157 |
| 3,663,122 | 5/1972 | Kitchen | 417/269 |

FOREIGN PATENTS OR APPLICATIONS

| | | | |
|---|---|---|---|
| 568,886 | 11/1957 | Italy | 417/269 |
| 558,548 | 3/1957 | Italy | 417/269 |

*Primary Examiner*—William L. Freeh
*Assistant Examiner*—G. P. La Pointe
*Attorney, Agent, or Firm*—Roylance, Abrams, Berdo & Kaul

[57] ABSTRACT

An improved lubrication system in a pump including a blocking rod mounted between seats on the pump frame and the swash plate, the rod having a channel therethrough from one seat to the other and a fluid conduit coupling the channel to a source of lubrication fluid at the seat on the pump frame. Each piston is connected to the swash plate by an axial connecting rod and the swash plate is provided with internal conduits coupling each rod seat on the swash plate to the swash plate blocking rod seat to provide lubrication to the connecting rods. Each connecting rod can also be provided with an internal channel to conduct fluid to its seat at the piston end.

2 Claims, 3 Drawing Figures

AXIAL PISTON PUMP

This invention relates to axial piston pumps and more particularly to pumps of this type having a fixed cylinder block.

Axial piston pumps are well known to specialists. In these pumps, the rotary movement of a shaft rotating around an axis is converted into an alternating rectilinear displacement of pistons parallel to the axis. One type comprises a fixed cylinder block and a rotating plate integral with the shaft, this plate having a surface inclined in relation to the axis. A swash plate, prevented from rotating, is mounted so as to bear on the inclined surface of the rotating plate. The end of each piston is connected by means of a longitudinal rod to this swash plate which thereby communicates to each piston a back and forth movement during the rotation of the rotary inclined plate.

In order to prevent the swash plate from rotating, one solution described in French Pat. No. 1,146,899 consists in utilizing a transverse blocking rod arranged between spherical seats mounted respectively on the frame and the swash plate. This rod is mounted in accordance with the rotating direction of the rotary place so as to be always under compression. The forces applied to the swash plate are thus distributed over the entire surface of the spherical seats. Up to now such an arrangement has only been used in pumps for hydraulic controls in which the lubricating and cooling fluid is merely the oil forced by the pump.

For pumps of general use and specially for those having a high power (several hundreds H.P.) it is necessary to provide lubricating and cooling means which first are efficient and reliable and secondly totally independent of the forced fluids.

The object of the invention is to propose such a means.

According to the invention, in a pump of the swash-plate type fitted with a transverse blocking rod, the lubricating means are characterized by the fact that they comprise a canal pierced in said transverse rod in order to allow the passage of a lubricating fluid from the frame of the pump to said swash plate.

Owing to this arrangement, from the fixed anchoring point of said transverse rod, it becomes possible to send a pressurized lubricating fluid to the different joints of the swash-plate under conditions of total reliability. In the absence of the arrangement according to the invention, a flexible pipe could merely be used to connect the generator of lubricating fluid to the swash-plate. But such a pipe would wear away particularly rapidly and the reliability of the whole pump would then be drastically decreased.

Preferably, longitudinal rods with spherical seats connect the pistons to the swash-plate which includes conduits to distribute the lubricant from the seat of the transverse rod to the different seats of the longitudinal connecting rods. Moreover, a canal can be pierced in each longitudinal connecting rod to allow the flow of lubricant to the seat of each longitudinal connecting rod on the corresponding piston.

Other features and advantages of the invention will appear from the following description, with reference to the appended drawings in which.

Figure 1:
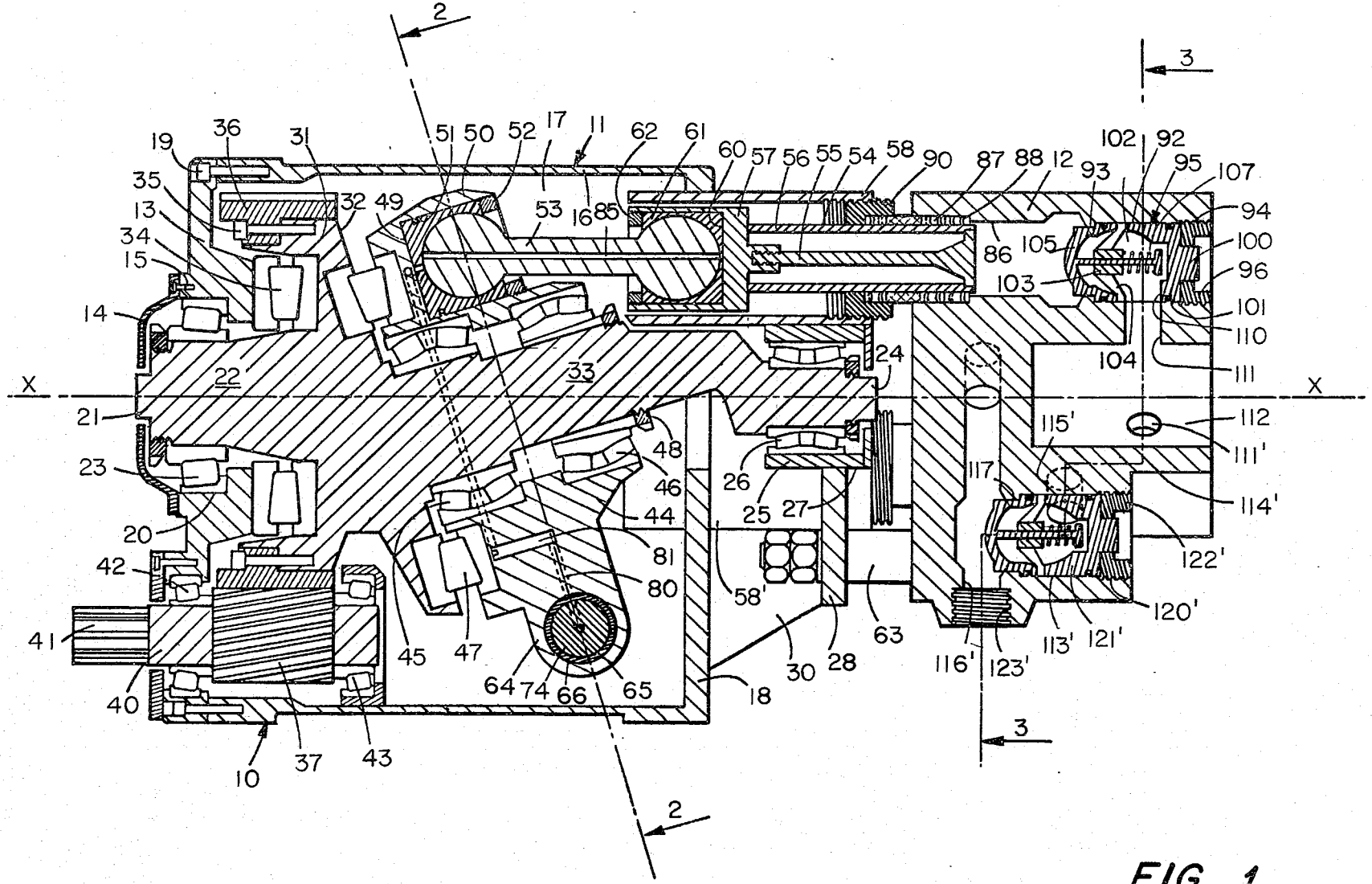
FIG. 1 is a longitudinal section of a pump according to the invention.

Referring to the figures, a pump 10 comprises a frame 11 and a cylinder block 12, fixed to each other and having a longitudinal axis X. The frame 11 consists, for example, of a base 13 on which is fixed a cover 14 by means of screws 15 and of a casing 16 attached to the base 13 by screws 19 and having a housing 17 closed by a transverse wall 18. The base 13 has a bore 20 along the axis X in which is mounted rotatingly one end 21 of a crankshaft 22 through a bearing 23. The crankshaft 22 goes through the housing 17 and includes, at the right of the figure, another end 24 mounted rotatingly in a sleeve 25 also in the axis X by means of a bearing 26. The sleeve 25 is fixed in a bore 27 of a plate 28 itself fixed, for example by braces 30, to the transverse wall 18.

Between these two ends 21 and 24, the crankshaft 22 has a rotary plate 31 having a flat surface 32 inclined in relation to the axis X, and extended by an inclined shaft 33, perpendicular to the flat surface 32. This rotating plate 31 bears on the base 13 by means of a taper roller thrust bearing 34. On the periphery of the rotating plate 31 is fixed, by means of screws 35, a ring gear 36 meshing with a helical pinion 37 integral with an input drive shaft 40. The drive shaft, which has a splined extension 41 going beyond the frame, is mounted rotatingly on bearings 42 and 43. The pinion 37 and the ring gear 36 constitute a reducer allowing the plate 31 to be driven rotatingly at a relatively low speed (for example, lower than 600 rpm).

On the inclined shaft 33 is rotatingly mounted a swash plate 44 via antifriction bearings 45 and 46 which may be replaced by babbit bearings. This swash plate 44, which bears on the inclined surface 32 by means of a roller thrust bearing 47, is held in place by means of a tapped ring 48 which is screwed on a threaded part of the inclined shaft 33.

Figure 2:
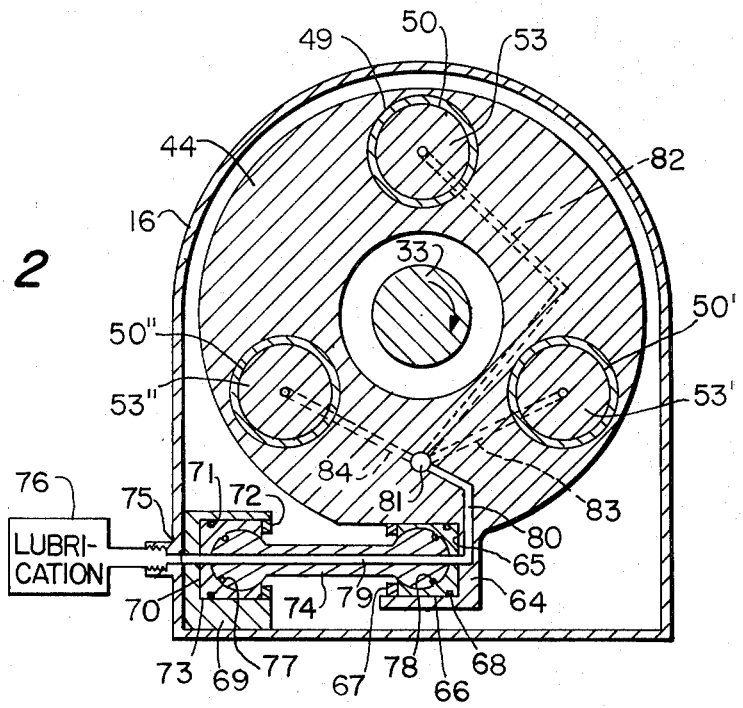
FIG. 2 is a cross section along the line 2—2 of FIG. 1.

The swash plate has cylindrical hollows such as 49, arranged regularly around the inclined shaft. The cylindrical hollow 49 is designed to receive a spherical seat 50 equipped on its periphery with a seal 51 and kept in place by a threaded ring 52. As can be seen in FIG. 2, the swash plate has three seats 50, 50' and 50'' arranged at 120° and corresponding to an equal number of pistons. The pump according to the invention can of course be made with a different number of pistons.

On the seat 50 bears the spherical end of a connecting rod 53 which links the swash plate 44 to a piston 54. The piston 54, consisting of an axial rod 55 and a liner 56, is fixed by the end of the axial rod onto a cylindrical crosshead 57 mounted movingly in a sleeve 58 having a babbit-metal lining. The crosshead 57 has a cylindrical recess 60 which receives a spherical seat 61 retained by a threaded ring 62 and on which bears the other end of the connecting rod 53. The other two pistons of the pump, arranged at 120° in relation to the axis X, are also respectively connected to the swash plate 44 by connecting rods identical to the rod 53 resting on spherical seats. The three sleeves such as 58 and 58' are placed in bores of the wall 18 of the frame 11 and are fixed to this wall by welding, for example. The plate 28, also having bores, maintains the other end of the three sleeves. The cylinder block 12 is fixed to this plate 28 by stud bolts 63.

The swash plate 44 includes, at its lower part, an extension 64, which may be an added piece, having a cylindrical recess 65 which opens laterally and in which is placed a spherical seat 66 retained by a threaded ring 67 and equipped on its periphery with a seal 68 (FIG. 2). Opposite the lateral opening of the recess 65, a block 69 is fixed to the frame. This block 69 has a recess 70 opening toward the extension 64 of the swash plate 44 and adapted to receive a spherical seat 71 retained by a threaded ring 72 and equipped on its periphery with a seal 73. Between the two spherical seats 66 and 71 is placed a transverse rod 74 which prevents the swash plate 44 from rotating. If, during the normal operation of the pump, the shaft 33 rotates in the direction of the arrow, the rod 74 is mounted on the left-hand side of FIG. 2 in order to be under compression. For an opposite rotating direction, the rod 74 would obviously be arranged on the other side.

The use of the transverse rod 74 as a means of securing the swash plate makes it possible to obtain a particularly intersecting lubrication system which we shall now describe.

Referring to FIG. 2, in the wall of the casing 16 and the block 69 is pierced a passage 75 which can provide a communication between a lubricant injection pump 76 and the spherical seat 71. In the transverse rod 74, whose ends are equipped with seals 77 and 78, is pierced a canal 79 which brings the lubricating fluid to the spherical seat 66. This canal 79 communicates with a conduit 80 made in the swash plate 44 and which brings the lubricating fluid into a chamber 81. The chamber 81 is connected to the base of the spherical seats 50, 50' and 50'' by individual conduits 82, 83 and 84 made in the mass of the swash plate. These conduits can also be tubes added on the swash plate. A canal 85 (FIG. 1) traversing the connecting rod 53 links the seat 50 with the seat 61. Similar canals are made in the other rods.

Thanks to this system, from the pump 76 it is possible to lubricate the different joints of the swash plate 44 as well as the spherical seats of the pistons. Such a lubrication system is possible only by using the cross rod 74 arrangement which makes it possible to place a fixed point on the frame from which the lubricant fluid can be introduced. Each spherical seat can be equipped with several openings providing communication between the different passages and conduits in spite of the slight rotations of the connecting rod ends on their seats.

Figure 3:
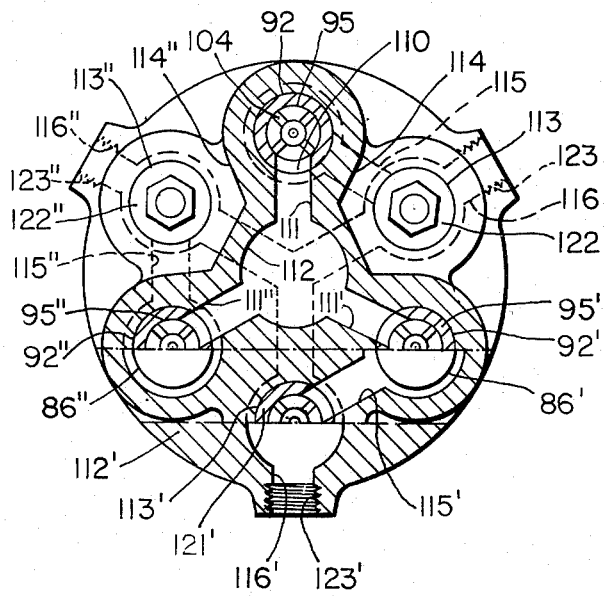
FIG. 3 is a cross section along the line 3—3 of FIG. 1.

In the cylinder block 12 are pierced three cylinders such as 86, in which the pistons slide. On the side of the plate 28, the cylinder 86 has a bore of larger diameter 87 in which are placed sealing rings 88. A threaded ring 90 screwed in the sleeve 58 makes it possible to compress these rings as desired while providing the guiding of the piston. In the extension of the cylinder 86, and on the side opposite the plate 28, is a bore 92 having, toward the inside, a shoulder 93 and, toward the outside, a thread 94. This bore is adapted to receive an admission valve 95 kept in place by a plug 96. In the extension of the other two cylinders 86' and 86'' are also made bores 92' and 92'' (FIG. 3) adapted to receive admission valves 95' and 95'' identical to the valve 95.

The valve 95 can have any conventional nonreturn valve form and, in particular, that shown in FIG. 1. Such a valve includes a body 100 in two parts, equipped on the outside with seals 101 and having an internal cavity 102. A sleeve 103 is maintained coaxially in the cavity 102 by fins 104 wedged between the two parts of the body 100. An obturator 105 integral with an axial rod sliding in the sleeve 103 is returned to its closing position by a spring 107. In the body of the valve is pierced a transverse opening 110 which provides communication between the inner cavity 102 and a passage 111 made radially in the cylinder block 12. The passage 111 leads into an axial admission chamber 112 also made in the cylinder block 12 and opening toward the outside of the pump. The valve 95 allows the passage of the fluid delivered by the pump from the admission chamber 112 to the cylinder 86, while preventing its passage in the opposite direction.

In the same radial plane as the passage 111, and forming an angle of 120° with it (FIG. 3) are made passages 111' and 111'' which respectively provide communication, within the cylinder block, between the admission chamber 112 and the two bores 92' and 92'', located in the extension of the cylinders 85' and 85''. The liquid or gas delivered under pressure by the pump is led by means of a pipe (not shown) into the admission chamber 112 from where it is distributed to the three cylinders by the respective passages 111, 111' and 111''.

The cylinder block 12 also has three bores 113, 113' and 113'' made parallel to the bores 92, 92' and 92'', and offset in relation to the latter by 60°. Opposite each of these bores, and on the side opposite the plate 28, a rounded cut 114, 114' and 114'' is made in the cylinder block. The bores 113, 113' and 113'' communicate respectively with the cylinders 86, 86' and 86'' through passages 115, 115' and 115'' made, in the cylinder block 12, in a transverse plane parallel to the plane of the passages 111, 111' and 111''. The bores 113, 113' and 113'' also communicate with the exterior through radial passages 116, 116' and 116'' cut in the cylinder block 12 in another transverse plane, also parallel to the plane of the passages 111, 111' and 111''.

The bore 113' (FIG. 1), which communicates with the cylinder 86', has an internal shoulder 117' and a tapped external part 120'. A discharge valve 121', mounted in the bore 113', bears on the shoulder 117' and is kept in place by a threaded plug 122'. Other identical discharge valves are mounted in the same manner in the bores 113 and 113''. These discharge valves can have the same form as the admission valve 95. The passage 116' has, toward the exterior, a tapped part 123' on which can be screwed an outlet pipe of the pump. The passages 116, 116' and 116'' extend up to the center of the cylinder block 12 so as to communicate between them. The discharge valve 121' allows the passage of the fluid delivered by the pump from the cylinder 86' to the tapped outlets 123, 123' and 123'' while preventing its passage in the opposite direction.

Summarizing, we see that the fluid delivered by the pump is admitted into the chamber 112, distributed to the three cylinders 86, 86', 86'' by the passages 111, 111', 111'' and the admission valves 95, 95', 95'', and then discharged through the passages 115, 115', 115'' and the discharge valves 121, 121', 121'' toward the outlet passages 116, 116', 116''. There are thus three outlets which can be connected to the three different pipes or to a ring connecting them to each other.

The pump just described is particularly well suited to high powers (over 500 HP) and especially for transmitting high torques at low speed (several hundred rpm); this pump may also be used for high speeds with a lower torque. In fact, the rods of the spherical seats and in particular the transverse rod are components well suited to supporting high compressive forces especially as, by construction, these forces are applied substantially along the longitudinal axis of the rods. Moreover, thanks to the use of a transverse rod to secure the swash plate, the pump can be equipped with a pressure lubrication system of great value with high powers.

The "in line" arrangement of the different components: rotating and swash plates, pistons and cylinder block, combined with a relatively low weight, results in a particularly interesting application to truck-mounted pumps, such as those used in the petroleum industry. Such a pump can of course have various technical forms without departing from the scope of the invention. In particular, the reducer previously described can be replaced by an epicyclic reducer allowing the input drive shaft to be aligned with the axis X.

What is claimed is:

1. In a high power pump of the type having a frame, a plate mounted on the frame for rotation about an axis, a drive shaft for driving the plate, the plate having a surface inclined with respect to the axis, a swash-plate bearing on the inclined surface of the rotating plate, a transverse blocking rod mounted between first and second seats attached to the frame and the swash-plate, respectively, to prevent rotation of the swash-plate relative to the frame, a cylinder block fixed to the frame in which pistons can slide parallel to said axis, and connecting means between said pistons and said swash-plate, the improvement comprising means defining a first passage in said first seat and a fixed inlet to said passage for receiving lubricating fluid under pressure;

means defining a second passage in said transverse blocking rod for establishing communication between said first seat and said second seat; and means defining a third passage in said second seat and said swash-plate for establishing communication between said second seat and said connecting means to lubricate said connecting means with said lubricating fluid.

2. A pump according to claim 1 wherein said connecting means comprises axially extending connecting rods, each connecting rod being located between a portion of one of said pistons and said swash-plate, and means defining a fourth passage in each of said connecting rods for establishing communication between both ends of said connecting rods to lubricate said portions of said pistons with said lubricating fluid.

* * * * *